United States Patent [19]

Stieler

[11] Patent Number: 4,737,119

[45] Date of Patent: Apr. 12, 1988

[54] CIRCULAR CONNECTOR

[75] Inventor: Alfred O. Stieler, Heilbronn-Bockingen, Fed. Rep. of Germany

[73] Assignee: Allied Corporation, Morris, N.J.

[21] Appl. No.: 16,451

[22] Filed: Feb. 20, 1987

Related U.S. Application Data

[63] Continuation of Ser. No. 763,509, Aug. 8, 1985, abandoned.

[30] Foreign Application Priority Data

Aug. 20, 1984 [DE] Fed. Rep. of Germany ... 8424654[U]

[51] Int. Cl.[4] ..... H01R 13/625

[52] U.S. Cl. ..... 439/318

[58] Field of Search ..... 339/88 R, 90 R, 90 C, 339/90 F, 181 C, 188 R, 188 C; 439/312–323

[56] References Cited

U.S. PATENT DOCUMENTS

| | | | |
|---|---|---|---|
| 2,264,687 | 12/1941 | Winkler et al. | 339/188 |
| 3,050,658 | 8/1962 | Lay et al. | 339/188 C |
| 3,901,574 | 8/1975 | Paullus et al. | 339/90 R |
| 3,986,765 | 10/1976 | Shaffer et al. | 339/90 R |
| 4,468,078 | 8/1984 | Frear et al. | 339/90 R |

FOREIGN PATENT DOCUMENTS

| | | | |
|---|---|---|---|
| 2263144 | 4/1982 | Fed. Rep. of Germany . | |
| 1505011 | 10/1967 | France . | |
| 2166198 | 8/1973 | France . | |
| 305681 | 11/1968 | Sweden | 339/90 R |
| 1568210 | 5/1980 | United Kingdom . | |
| 2065759 | 7/1981 | United Kingdom . | |

*Primary Examiner*—John McQuade

*Attorney, Agent, or Firm*—Bacon & Thomas

[57] ABSTRACT

A circular connector for a plug-type connection to a mating connector which uses complementary locking means that are engaged and disengaged by rotation. Helical locking grooves are provided which have a bayonet detent space extending in an axial direction and an adjacent detent space extending in the peripheral direction. The detent space is defined by limiting means. Complementary noses on the mating connector are movable by rotation along the grooves into the detent spaces to lock the connectors.

9 Claims, 3 Drawing Sheets

CIRCULAR CONNECTOR

This application is a continuation of application Ser. No. 763,509 filed Aug. 8, 1985, now abandoned.

BACKGROUND OF THE INVENTION

1. Field of the Invention

This invention relates to a connector, in particular a circular connector.

2. Description of the Prior Art

To enable a plug connection to be established in general a plug connector containing, for example, contact pins and a mating connector containing, for example, female contacts are required. In many uses it is necessary to secure the plug-type connection thus established by complementary locking means so that when vibrations or other phenomena tending to release the plug-type connection occur the connection is not loosened.

A great number of possibilities is already known for providing locking means between the connector and the mating connector. They are frequently based on the principle of a bayonet fastener. The bayonet fasteners used for plug-type connectors frequently employ an undercutting at the end of a helical path adapted to be brought into engagement with a nose on the mating connector. This undercutting forms a detent space which extends in the axial direction of the plug connector and in which the nose is held by the action of a spring or a sealing ring. A considerable strain on the material occurs at the transition of the nose out of the helical path into the bayonet detent space. This also applies to the plug-type connector according to German Pat. No. 2,263,144. In this patent at the outer periphery of a component of the plug connector two grooves offset by about 180° are provided. Each groove has entry curves and forms bayonet tracks and at the ends of the grooves opposite the entry curves detent spaces are formed which are closed on the inlet curve side by limiting means in the form of projections. On a securing ring of the mating connector two diametrically opposite noses are formed which by rotation of the securing ring in the closure direction can be turned beyond the projections to engage in the detent spaces formed therebehind.

It would be desirable if a connector were provided in which the high material stresses arising in the conventional bayonet fastener and also in other detent means are reduced. Furthermore, it would be desirable to provide a connector in which tensioning of the noses which is abrupt and therefore requires a high force expenditure before dropping into the detent spaces is avoided.

SUMMARY OF THE INVENTION

In accordance with this invention, there is provided a circular connector for establishing a plug-type connection to a mating connector using complementary locking means which are engaged by rotation in a first closure direction and which can be released by rotation in a second opening direction, the connector comprising a plurality of helical grooves, each of the grooves having a bayonet detent space extending in the axial direction of the connector and a detent space adjacent thereto and extending in the peripheral direction of the connector, the detent space being defined by limiting means, whereby complementary noses provided on the mating connector may be moveable by rotation in the closure direction along the grooves into the bayonet detent space.

To solve the above problems this invention provides that adjacent the bayonet detent space an additional detent space is provided which is arranged in the closure direction of rotation and which is defined by an elevation. The invention further provides that the elevations have a radial extent towards the entry curves, i.e. opposite to the closure direction of rotation, which rises only gradually to the maximum.

Preferably, the rise to the maximum radial extent takes place starting from the wall thickness of the groove bottom over an angle of about 15° to 45°.

DESCRIPTION OF THE PREFERRED EMBODIMENTS

Figure 1:
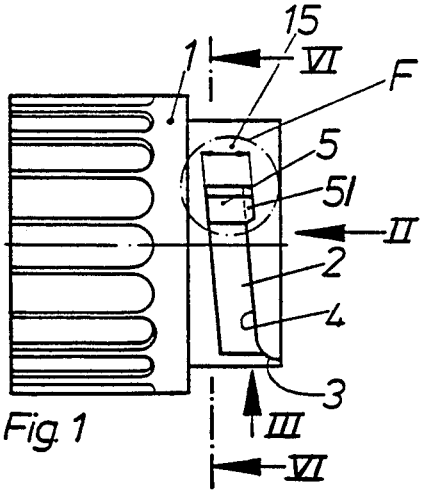
FIG. 1 shows a closure ring of a connector in side elevation.
Figure 4:
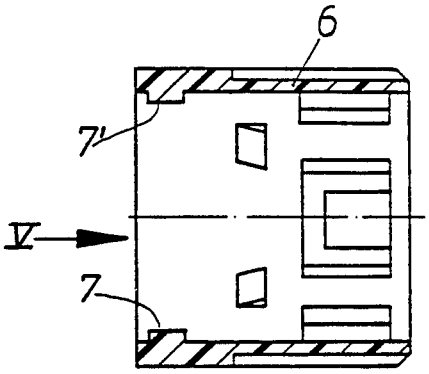
FIG. 4 is a section through a mating closure ring of the mating connector.
Figure 2:
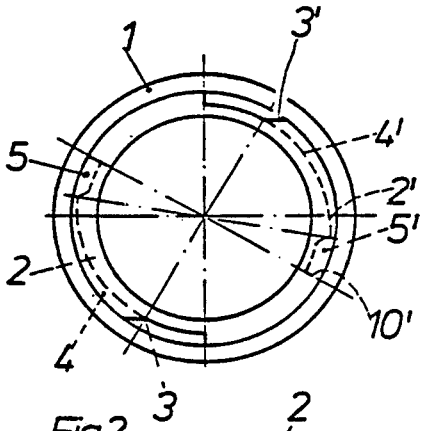
FIG. 2 is a side view of the closure ring of FIG. 1 from the direction of the arrow II in FIG. 1.
Figure 5:
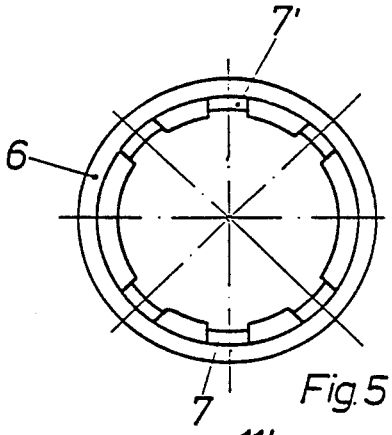
FIG. 5 is an end view from the direction of the arrow V of FIG. 4.
Figure 3:
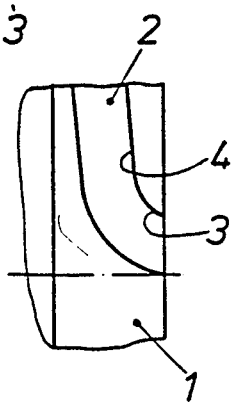
FIG. 3 is a detail of the closure ring according to FIG. 1 substantially from the direction of the arrow III of FIG. 1.
Figure 6:
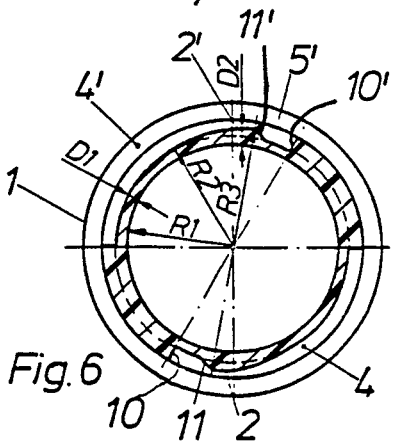
FIG. 6 is a section along the line VI—VI of FIG. 1.
Figure 7:
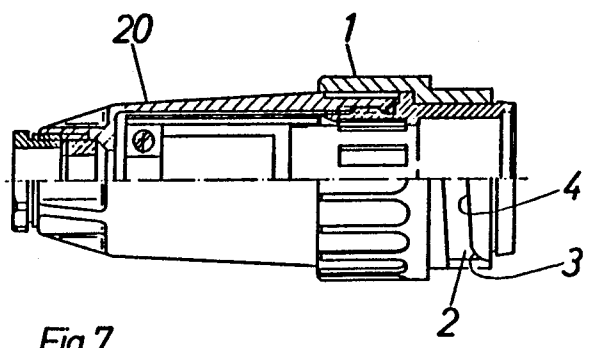
FIG. 7 shows a connector having a closure ring according to FIGS. 1, 2, 3 and 6, partially in section.

With reference to the drawings, FIG. 2 shows a closure ring 1 of a connector 20 illustrated in FIG. 7. FIG. 4 shows a mating closure ring 6 of a mating connector 21 illustrated in FIGS. 8 and 9. FIG. 10 shows the plug-type connection 22 formed by the connector 20 and mating connector 21.

Figure 11:
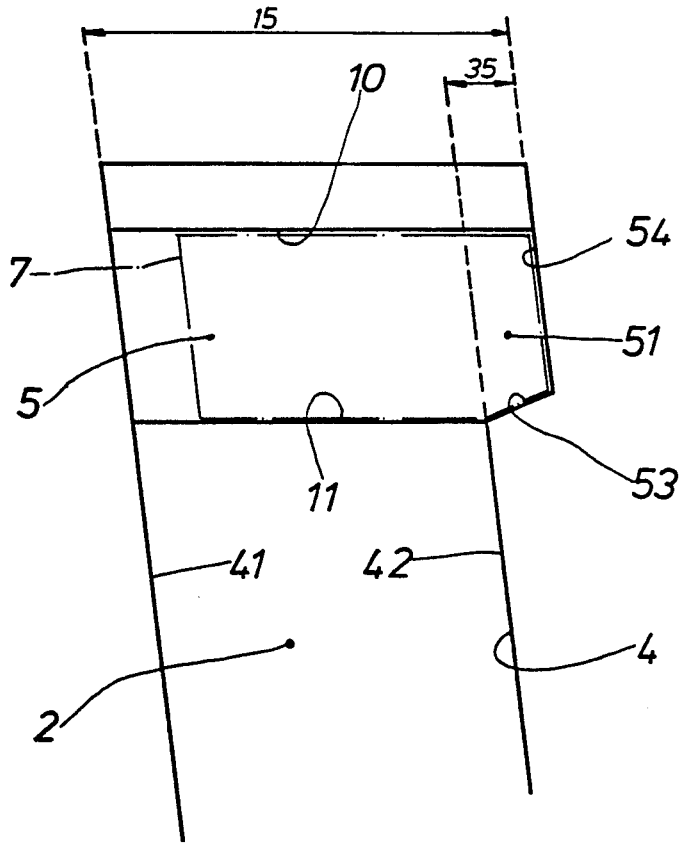
FIG. 11 is a detail of F shown in FIG. 1.

Closure ring 1, as shown in FIGS. 1, 2, 3 and 6, comprises at its outer periphery two bayonet paths 4 and 4' formed by grooves. The bayonet paths 4 referred to hereinafter as grooves extend substantially helically each over substantially an angular range of 45°. The grooves are defined in each case by side walls 41, 42 (FIG. 11).

To permit access for the noses 7, 7' on the counter-mating ring 6, which are described in detail hereinafter, entry curves 3, 3' opening towards the end face of the closure ring 1 are provided. At the oppositely disposed end of the grooves 4, 4' according to the invention bayonet detent spaces 51 extending in the axial direction are formed as well as detents or detent spaces 5, 5' extending in the peripheral direction. These detent spaces are defined in the peripheral direction on the one hand by stop faces 10, 10' and on the other by detent faces 11, 11' which are arranged in the direction towards the entry curves 3, 3' or oppositely to a closure direction of rotation as described below.

The grooves 4 have a width which is somewhat greater than the width of the noses 7. The width 15 of the two detent chambers 5 and 51 is somewhat greater than the width of the grooves 4, 4'. According to this invention the detent space (or spaces) 51 is formed by an undercut 53 extending from the side wall 42 of the groove 4 and defined by the wall 54 offset in the axial direction with respect to the wall 42. The width 35 of the undercut 53 is small compared with the width of the nose 7, 7' in order to reduce the material stressing on engagement and disengagement of the nose 7, 7' in the bayonet detent space 51. Preferably, the width 35 of the bayonet detent space 51 is about a quarter of the total width 15 of the two detent spaces 5, 51. In order to ensure in spite of the relatively small undercutting 53 that a coupling is achieved which can withstand any stress forces occurring in use of the connector, the invention provides a detent space 5 as conventional.

The invention further provides that the boundary of the detent spaces 5, 5' in the direction towards the entry curves 3, 3' is formed by a curved elevation 2, 2' gradually rising in the closure direction of rotation. This is shown in detail in FIG. 6 for the curved elevation 2'. The gradual rise of curved elevation 2' or of the radial extent thereof starts substantially at the arrow tip of the radius $R_2$ in FIG. 6. The thickness of the groove bottom wall $D_1$ (FIG. 6) rises up to a maximum value of the thickness $D_2$ substantially adjacent the arrow tip of $R_3$. The radial extent of the curved elevation has its maximum value there and then drops to the detent space 5' over the detent face 11'. The detent face 11' (like the detent face 11) is also inclined substantially at 45° so that on application of a corresponding force a movement of the noses 7, 7' out of the associated detent spaces 5, 5' is possible.

The radius $R_1$ denotes the position of the bottom side and $R_2$ the upper side of the groove bottom wall, i.e. the groove bottom, and $R_3$, indicates the maximum radial extent of the curved elevation 2, 2', i.e. of the groove bottom.

In the description of the closure ring 1 reference has already been made to the mating closure ring 6 comprising the noses 7, 7'. The mating closure ring 6 is formed in the example of the illustrated embodiment fixedly on the mating connector 21.

Figure 9:
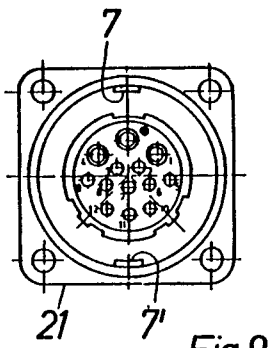
FIG. 9 is the mating connector in plan view.
Figure 8:
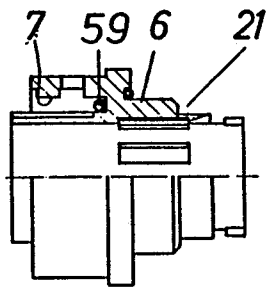
FIG. 8 is a partially sectioned side view of a mating connector according to FIG. 9.
Figure 10:
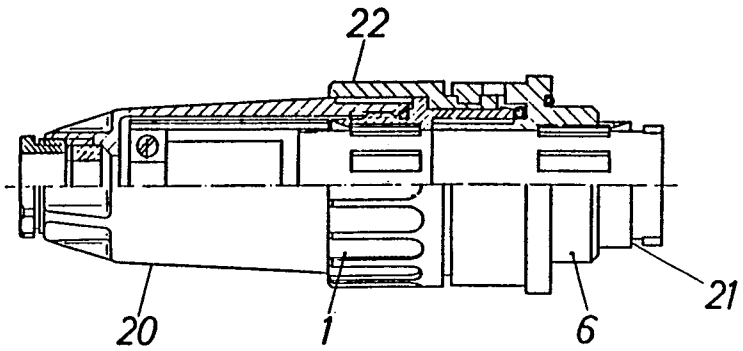
FIG. 10 is a plug-type connection established by connecting the connector according to FIG. 7 to the connector according to FIGS. 8 and 9.

To form the plug-type connection shown in FIG. 10 firstly the connector 20 in accordance with FIG. 7 is inserted with its pin contacts into the female contacts of the mating connector 21 (see also FIG. 9). In this insertion operation by appropriate turning of the closure ring 1 it is ensured that the noses 7, 7' are inserted in the associated entry curves 3, 3'. The mating closure ring 1 is then turned clockwise in the closure rotation direction, the connector 20 being drawn in the axial direction against the mating connector 21 due to the helical configuration of the bayonet paths 4, 4'. On rotation of the closure ring 1 in the clockwise direction the noses 7, 7' run up slowly and gradually on the curved elevations 2, 2' and are pressed outwardly in the radial direction and after passing the maximum radial extent of the curved elevations 2 then drop into the detent spaces 5, 5'. Furthermore, on opposite rotation the resilient sealing ring 59 shown in FIG. 8 is compressed and effects the movement of the noses 7, 7' into the associated bayonet detent spaces 51 (only one is shown). Preferably, the material chosen to make the mating connector 6 has adequate resiliency so that the noses 7, 7' can be moved radially outwardly and can also reliably drop into the detent spaces 5, 5'.

The connector 1 is preferably formed of plastic but the bottom of the groove 2, 2' is not resilient.

It is however also possible to provide a resilient groove bottom of the grooves 2, 2', and the noses 7, 7' then need not necessarily be resiliently yieldable in the radial direction.

It is further possible to make the curved elevations 2, 2' either from plastic or from metal.

It is further pointed out that the grooves 2, 2' may also be formed on the mating connector 6, the noses 7, 7' of the mating connector 6 then being formed on the connector 1. It is alternatively possible to form the grooves 2, 2' not at the upper side of the closure ring as shown but at the inner side, the noses 7, 7' then being formed on the outer side of the mating connector 6.

Preferably, three noses 7, 7' and three grooves 2, 2' are present, the angular distance thereof being 120°. This gives a more uniform pulling force. However, connectors with two noses and grooves can be made in a less expensive manner.

What is claimed is:

1. A circular connector for establishing a plug-type connection to a mating connector, said connectors being locked together upon relative rotation in a first closure direction and being released by relative rotation in a second opening direction, said mating connector having a plurality of locking noses, said circular connector comprising:

a plurality of helical grooves; each of said grooves having an entry mouth to receive a complementary locking nose on said mating connector, a curved elevation, and terminating in a detent space extending in the peripheral direction of said circular connector, each said detent space being defined by a terminal stop face and a detent face on said curved elevation, said curved elevation having a radial extend which gradually rises in the closure direction over an angular range of about 15° to 45° and reaches a maximum adjacent to said detent space; and a bayonnet detent space adjacent to each detent space and extending in the axial direction of said circular connector, said bayonnet detent space being adapted to receive said complementary locking nose upon completion of said relative rotation is said first closure direction along said groove;

said detent space and said bayonnet detent space cooperating to retain said complementary locking nose whereby said circular connector and said mating connector are locked together.

2. The connector according to claim 1, wherein said bayonnet detent space is formed by an undercut extending from a sidewall of said groove and terminates in a wall offset in the axial direction with respect to said sidewall.

3. The connector according to claim 2, wherein the width of said undercut is small compared with the width of each nose.

4. The connector according to claim 3, wherein two grooves and two noses are provided.

5. The connector according to claim 1, wherein said grooves are provided in a rotatable closure ring, and said noses are provided on a fixed closure ring of said mating connector.

6. The connector according to claim 1, wherein three grooves offset by 120° and three noses offset by 120° are provided.

7. The connector according to claim 4, wherein said two grooves are offset by 180° and said two noses are offset by 180°.

8. The connector according to claim 4, wherein the width of said undercut is about one-fourth the total width of said detent space and said bayonnet detent space.

9. The connector of claim 4, wherein said connector is formed of plastic.

* * * * *